US005496975A

United States Patent [19]

Wagner

[11] Patent Number: 5,496,975

[45] Date of Patent: Mar. 5, 1996

[54] PLUG MUFFLER FOR AIRCRAFT AND METHOD OF CONSTRUCTION THEREOF

[76] Inventor: Dane Wagner, P.O. Box 211291, Anchorage, Ak. 99521

[21] Appl. No.: 254,782

[22] Filed: Jun. 6, 1994

[51] Int. Cl.[6] ..... F01N 1/08

[52] U.S. Cl. ..... 181/269; 181/273; 181/276; 181/281

[58] Field of Search ..... 181/213, 224, 181/227, 228, 264, 268, 269, 275, 276, 281, 282; 165/154; 60/322

[56] References Cited

U.S. PATENT DOCUMENTS

| | | | |
|---|---|---|---|
| 2,828,830 | 4/1958 | Clark | 181/275 |
| 3,997,002 | 12/1976 | Baker et al. | 165/154 |
| 5,276,291 | 1/1994 | Norris | 181/224 |

*Primary Examiner*—Khanh Dang
*Attorney, Agent, or Firm*—Michael J. Tavella

[57] ABSTRACT

An improved aircraft muffler and the method of making it is disclosed. It is a plug muffler design having an outer housing and an internal exhaust conduit. The exhaust conduit has a center partition that blocks the flow of exhaust gas through the conduit. A number of holes are formed through the conduit wall such that the exhaust gas passes out through the holes on the inlet side of the partition and reenter the conduit on the outlet side of the partition. Unlike previous designs, the holes formed in the exhaust tube of the muffler are not flat and do not have hoods. Rather they have formed surfaces that slope. The formed surfaces both protrude above and below the exhaust tube wall. Thus the formed surface creates a directional flow path for the airflow to help increase the velocity, which consequently helps to move exhaust gases through the baffle as opposed to straight holes. The indented holes serve another purpose. Those surrounding the center plug act to wedge the plug in place by forming a circumferential, integral bead lock around the partition plate, which secures it in a fixed, stationary position. This, coupled with a series of welds placed around the tube, keeps the plug from falling over or becoming loose within the exhaust tube.

9 Claims, 4 Drawing Sheets

PLUG MUFFLER FOR AIRCRAFT AND METHOD OF CONSTRUCTION THEREOF

BACKGROUND OF THE INVENTION

One type of present day small aircraft muffler currently used has a series of cones that are tack welded to small diameter rods. This assembly is placed within a housing that has an inlet and an outlet. Although this muffler design works well to muffle noise, it has a tendency to fail. Vibration and heat often cause one or more of the cones to break free of the welds. In many cases, the outlet side cone will invert and become lodged in the outlet of the muffler causing immediate power loss due to extreme back pressure in the introduction system. If this power loss occurs during takeoff, a crash is highly likely. The cones will also break loose in the center of the muffler, which will cause the exhaust gases to be directed toward the muffler housing. This will cause flame impingement that will lead to fatigue in the metal and eventual failure. This failure will often release carbon monoxide into the cabin heating system because mufflers are often used as heat exchangers in such systems. Over the years many different muffler designs have been tested and tried. One such design is the so-called "plug" muffler. A plug muffler works by placing a solid plug in the center of an exhaust tube. Holes are provided about the circumference of the exhaust tube. The exhaust enters the inlet of the tube and is forced outward through the holes because it cannot pass through the plug. A corresponding set of holes is provided on the outlet end of the muffler to permit the exhaust to reenter the exhaust tube where it can exit to the atmosphere. This movement through the holes acts to attenuate the sound emitted from the muffler.

An example of a plug muffler design is U.S. Pat. No. 3,997,002 to Baker et al. This muffler was designed to be used in a kit form where the exhaust gas conduit could be easily removed from the shell and replaced. In practice, this muffler has several problems. The heat experienced within the muffler often caused the tube to gall and expand. Many times, the plug would come loose and open the exhaust tube, thereby reducing the effectiveness of the muffler. Once the tube expands or galls, it is impossible to remove it from the housing. Often these tubes must be cut from the housing, ruining the muffler. The Baker et al. design uses simple holes drilled into the cylindrical exhaust tube.

U.S. Pat. No. 2,828,830 to Clark shows a plug muffler having directional hoods formed over the holes. These hoods assist the airflow through the housing. Although these hoods do make some improvement, they do nothing but rise above the tube surface. Moreover, the hoods can act as impediments to the airflow as it reenters the exhaust tube, which can cause the exhaust gases to "search" for an opening, possibly increasing the back pressure to the induction system.

SUMMARY OF THE INVENTION

The present invention overcomes these difficulties. It comprises a plug muffler design having an outer housing and an internal exhaust conduit. The exhaust conduit has a center partition that blocks the flow of exhaust gas through the conduit. A number of holes are formed through the conduit wall such that the exhaust gas passes out through the holes on the inlet side of the partition and reenter the conduit on the outlet side of the partition. Unlike previous designs, the holes formed in the exhaust tube of this invention are not flat and do not have hoods. Rather they have aerodynamically formed surfaces that slope smoothly. The formed surfaces both protrude above and below the exhaust tube wall. Thus the formed surface creates an angled path for the airflow. The angle into the tube produces a streamlined effect that gives truly efficient airflow from the inlet up into the housing and back down into the outlet. The angled holes serve another purpose. Those surrounding the center plug act to wedge the plug in place by forming an integral bead lock around the plug. This bead lock is automatically formed as the holes are worked. This, coupled with a series of welds placed around the tube, keeps the plug from falling over or becoming loose within the exhaust tube. The system of angled holes also provides increased structural integrity to the baffle when compared to straight holes or protruding hoods.

It is an object of this invention to produce a plug muffler that improves the airflow through the muffler, while still meeting the required attenuation limits promulgated by the Federal Aviation Administration and the Environmental Protection Agency.

It is another object of this invention to provide a means to strengthen the joint holding the plug to prevent it from failing from fatigue during prolonged use.

It is another object of this invention to provide a means to strengthen the integrity of both the longitudinal axis and circumferential axis of the baffle, which extends the life of the baffle and reduces maintenance.

It is yet another object of this invention to produce a muffler that is easily reparable through replacement of worn components.

DISCUSSION OF THE PRIOR ART

Figure 1:
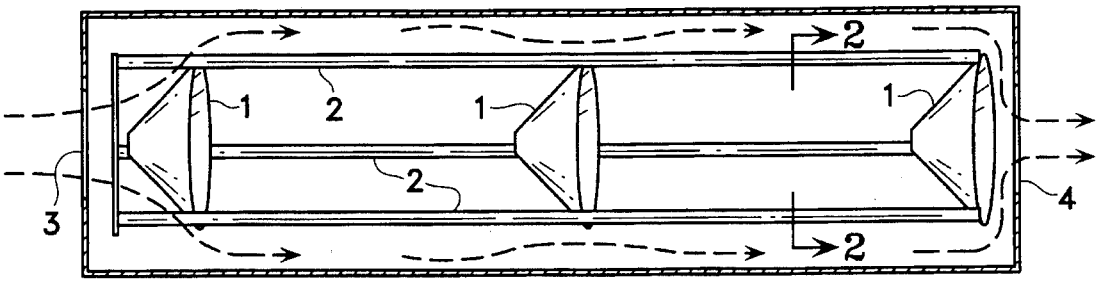
Fig. 1 (Prior Art)
FIG. 1 is a side view of the internal baffle design of a cone type muffler, as prior art.
Figure 2:
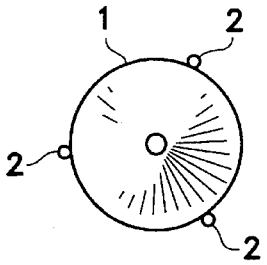
Fig. 2 (Prior Art)
FIG. 2 is an end view of the cone type muffler taken along the lines 2—2, as prior art.
Figure 3:
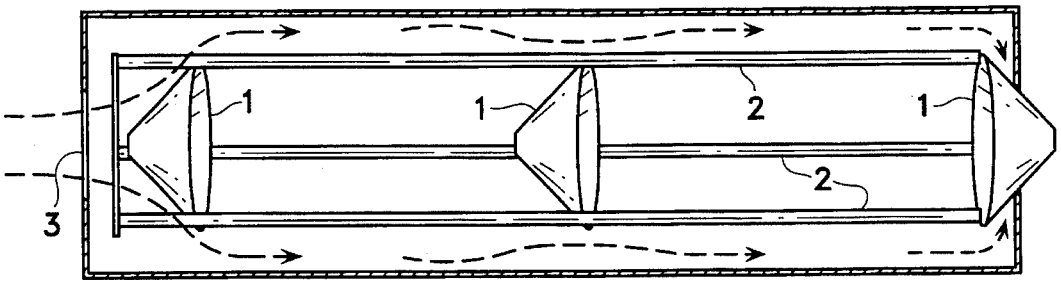
Fig. 3 (Prior Art)
FIG. 3 is a side view of the cone type muffler with one cone inverted as prior art.

Referring now to the drawings and particularly to FIGS. 1 through 5, three different prior art designs are shown. FIGS. 1 through 3 show a popular muffler design in use today. It uses a series of cone baffles 1 to muffle exhaust noise. The baffles 1 are attached to three small rods 2 typically by welding. The rods are spaced equidistantly around the cone baffles 1. See, e.g., FIG. 2. This assembly is then placed into a housing that has an inlet port 3 and an outlet port 4. The major problem with this design is that the welds eventually become weak and the cones may become inverted (see FIG. 3). If that occurs, the inverted cone may block the inlet or outlet causing muffler failure and possible engine failure, which could result in a crash if it occurs at takeoff. Note that airflow is show by the broken arrow lines on the figures.

Figure 4:
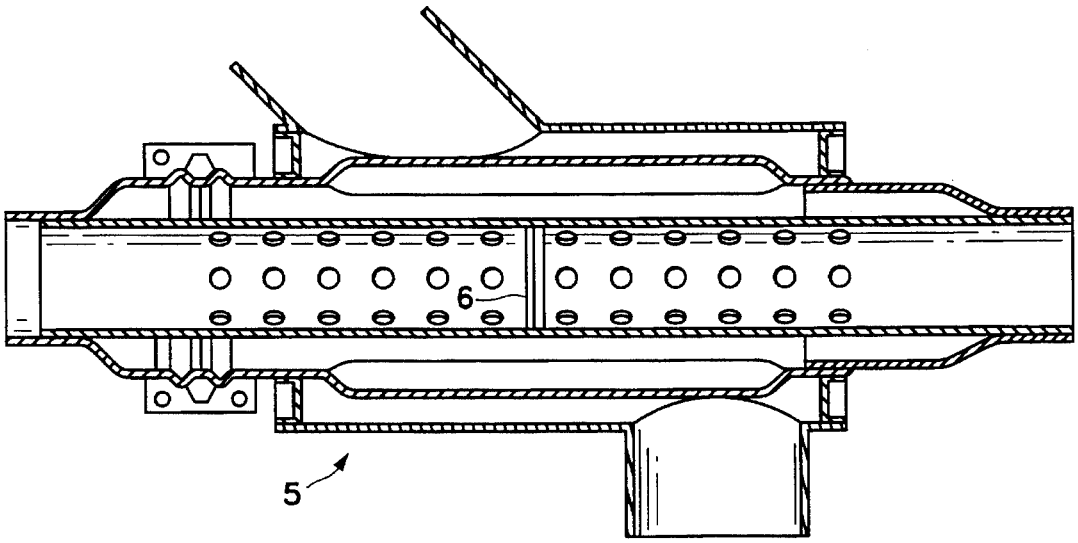
Fig. 4 (Prior Art)
FIG. 4 is a side view of the Baker et al. design as prior art.

FIG. 4 shows a side view of U.S. Pat. No. 3,997,002 to Baker et al. The Baker design shows a plug type muffler 5. In this design, the plug 6 often slips out of position, thereby reducing the effectiveness and longevity of the muffler.

Figure 5:
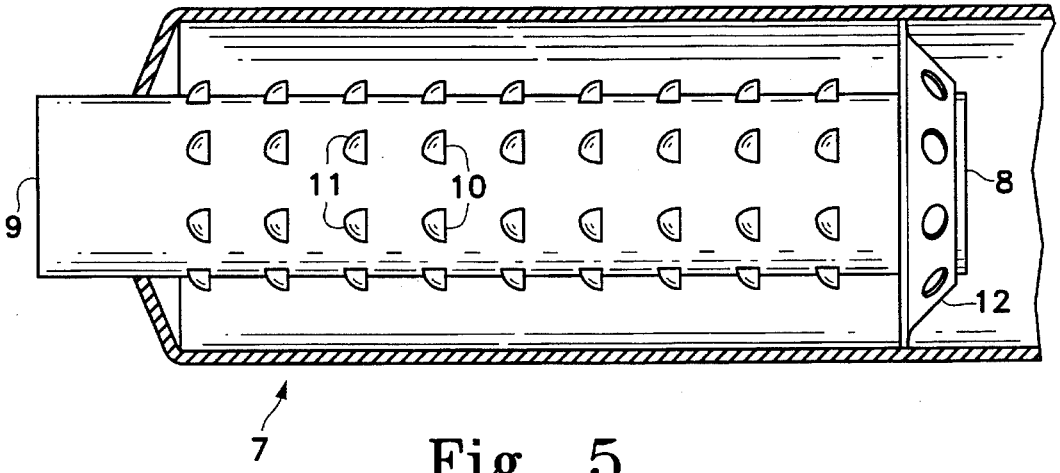
Fig. 5 (Prior Art)
FIG. 5 is a side view of the Clark design as prior art.

Finally, FIG. 5 shows U.S. Pat. No. 2,282,830 to Clark. This design is a plug muffler 7 that is plugged on the end 8. Exhaust enters the muffler at inlet 9 where it is forced out of holes 10. These holes have hoods 11 on them to help direct airflow. The exhaust is then removed through holes in an end flange 12.

DETAILED DESCRIPTION OF THE INVENTION

Figure 6:
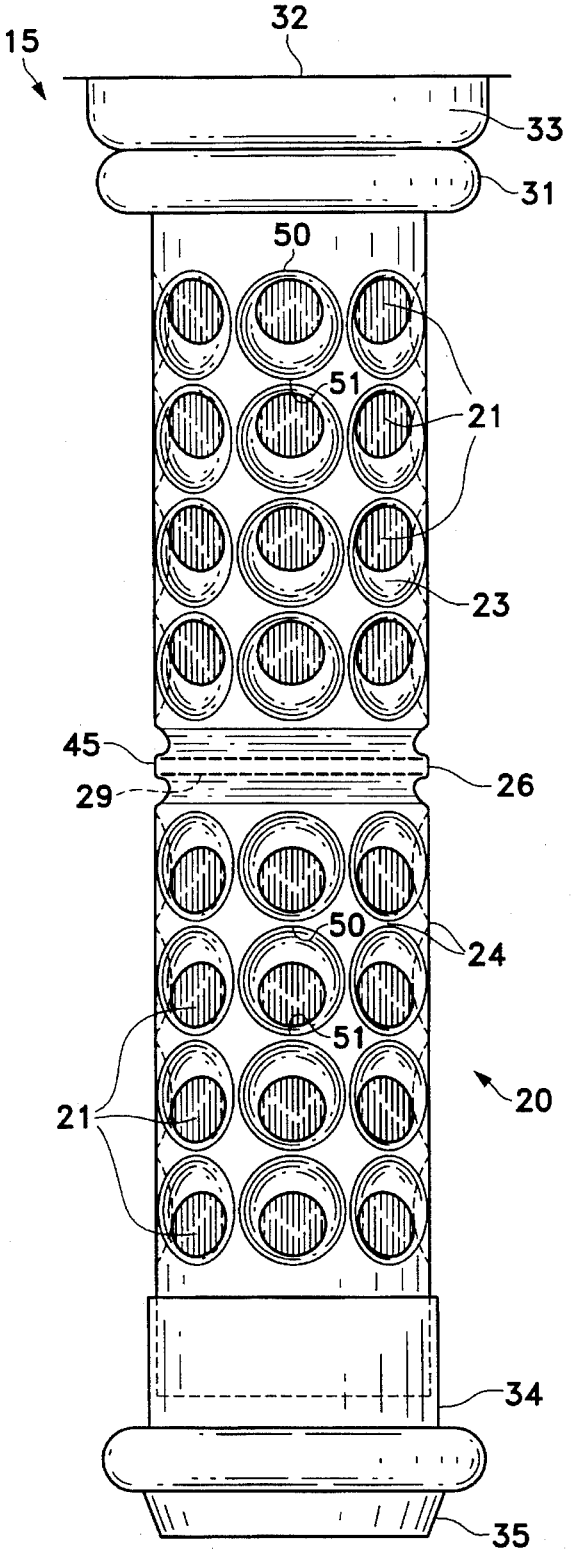
FIG. 6 is a side view of the preferred embodiment with the outer housing removed.
Figure 7:
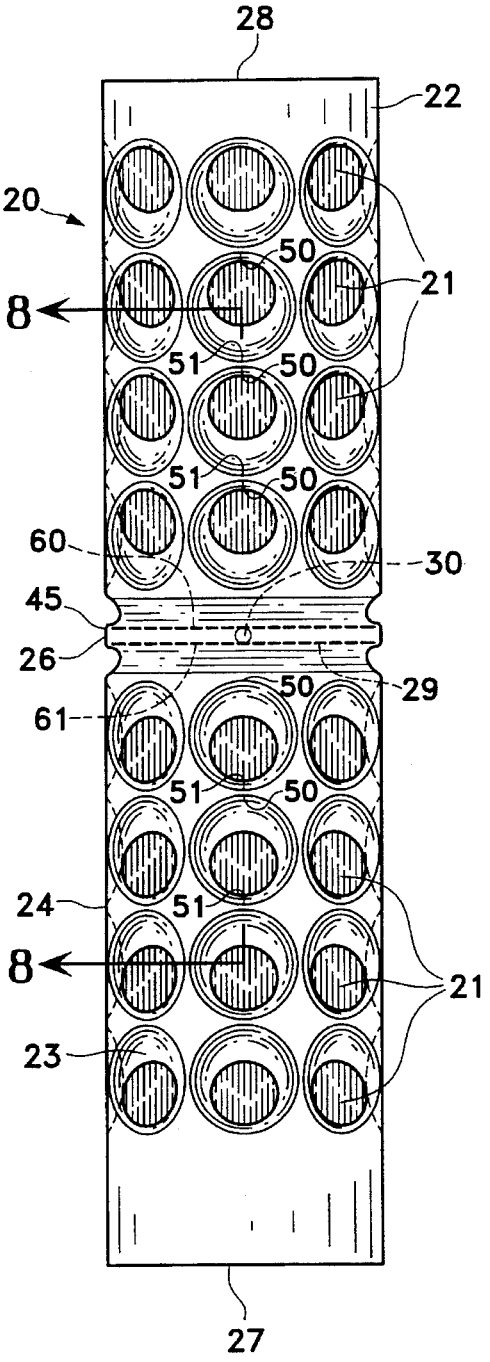
FIG. 7 is a detail of the exhaust tube of the preferred embodiment.
Figure 8:
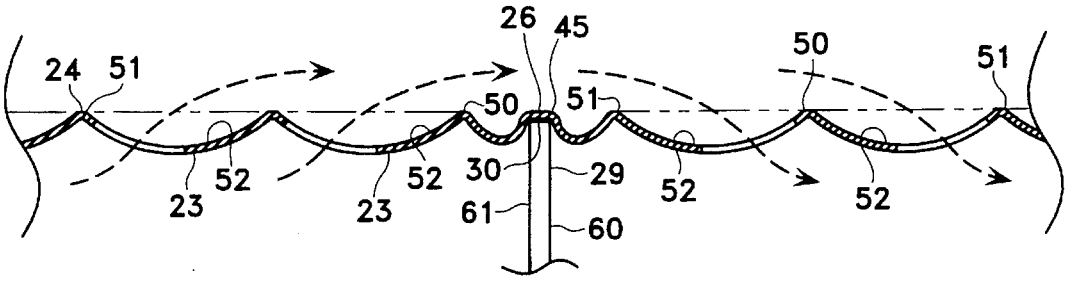
FIG. 8 is a detail of a cross sectional view of the exhaust tube taken along the lines 8—8, showing a series of exhaust holes.
Figure 9:
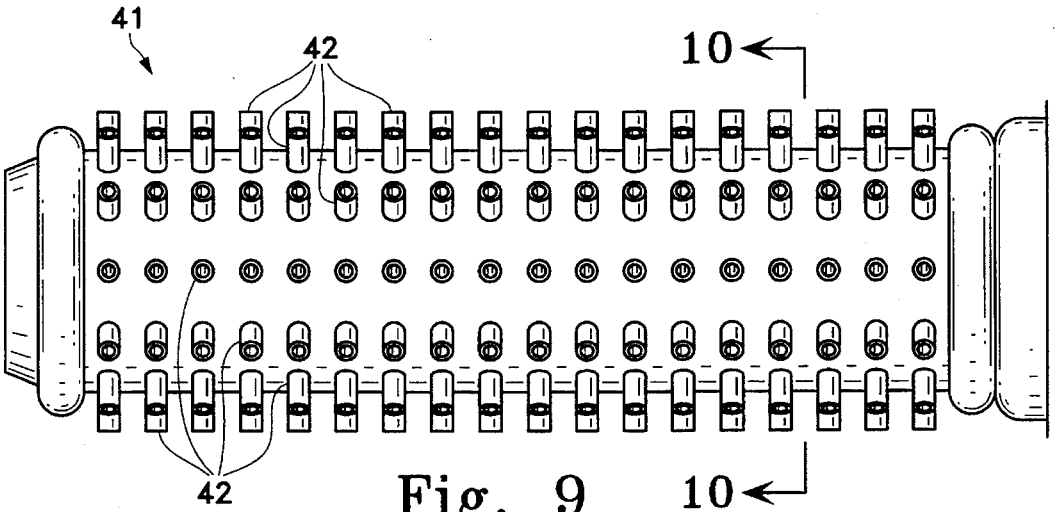
FIG. 9 is a side view of the outer housing.

Referring now to FIGS. 6 through 10, the present invention is a plug muffler 15 that has directional air flow. The preferred embodiment has several components. For convenience, the device will be described from the inside out and begins with an exhaust gas conduit 20. Referring now to FIG. 7, the exhaust gas conduit 20 is a hollow cylinder that is sized for the appropriate use. For example, in one design the exhaust gas conduit is approximately 2.5 inches in diameter and is 9.75 inches long. A number of holes 21 are drilled into the cylindrical wall 22 of the exhaust gas conduit 20 as shown. The holes 21 may be considered to be a plurality of perforations formed through the cylindrical wall of the exhaust gas conduit 20. The holes should be placed symmetrically around the exhaust gas conduit 20 and should be equally spaced over the length of the exhaust gas conduit 20. Each of the holes 21, has a point 50 that is closest to the inlet 28, or inlet side 28 of the cylindrical tube 20, and a point 51 that is closest to the outlet 27 or outlet side 27 of the cylindrical tube 20 as shown in FIG. 7. The holes 21 are then distorted to create a flare 24 on either the point 50 closest to the inlet side 28 or the point 51, closest to the outlet side 27 as shown in FIG. 8, and as discussed in more detail below. A depression 23 is formed on the point opposite that of point 50 or point 51, depending on the air flow, as discussed below and as shown in FIG. 8. Where a flare has been made at point 50 in a hole 21, the depression is formed at point 52 as shown in FIG. 8. Where the flare has been formed at point 51 on a hole 21, the depression if formed at point 52 as shown. See, e.g., FIG. 8. These distortions are done for each hole and are formed lengthwise on the exhaust gas conduit 20. The depression 23 is formed by depressing the cylindrical wall downward at the point 52 closest to the inlet side 28 of the exhaust gas conduit 20. In the preferred embodiment, the angle of the flare 24 and depression 23 is approximately 30 degrees. The flaring direction is oriented towards the respective ends of the exhaust gas conduit 20, beginning at the longitudinal center point 26 of the exhaust gas conduit 20. Thus, as shown in FIG. 7, the flares 24 to the left of the center point 26 are oriented toward the left end (outlet) 27 of the exhaust gas conduit 20 and the flares 24 to the right of the center point 26 are oriented toward the right end (inlet) 28 of the exhaust gas conduit 20. A partition plate 29 is installed within the exhaust gas conduit 20 as shown. It is sized to completely fit within the exhaust gas conduit 20 and to seal the interior of the conduit to prevent the flow of exhaust through the exhaust gas conduit 20. The partition plate 29 acts to divide the exhaust conduit 20 into two sections or sides: an inlet side 28 and an outlet side 27. Accordingly, the partition plate 29 has an inlet side 60 and an outlet side 61. The partition plate 29 is secured into place by welding. Referring now to FIGS. 7 and 8, the preferred embodiment uses four welds 30 spaced 90 degrees apart about the circumference of the exhaust gas conduit 20. In addition to the welds 30, the depressions 23 formed in the sets of holes 21 that are adjacent to the partition plate 29, act as supports for the partition plate 29 to keep it from moving or turning (see FIG. 8). To achieve this effect, the partition plate 29 must have sufficient thickness and the inner holes 21 must be positioned close enough to the plate. If these conditions are met, the flares 24 on holes 21 form an inherent, integral bead lock 45 around the partition plate 29. This bead lock is automatically formed as the holes are worked.

Referring now to FIG. 6, several components are added to the exhaust gas conduit 20 to form the entire muffler 15. FIG. 7 shows the exhaust gas conduit 20 having an outlet end 27 and an inlet end 28. A female ball joint 31 is welded to the inlet end 28. Prior to welding the female ball joint 31, an end plate 32 is positioned on the female ball joint 31 and welded in place. A ball joint flange 33 is installed on the female ball joint 31, prior to welding the female ball joint 31 to the inlet end 28 of the exhaust gas conduit 20. The ball joint flange 33 is loose fitting and can be turned completely around the female ball joint 31. This allows the ball joint flange 33 to match a corresponding flange on a collector outlet, attached to an aircraft engine. The ball joint flange 33 then clamps to a collector male ball joint (not shown) attached to the collector outlet.

On the outlet end 27, a male beaded end 34 is welded to an end plate 35. This assembly then slips over the outlet end 27 of the exhaust gas conduit 20 as an expansion joint for the exhaust gas conduit 20. The male beaded end 34 then fits to an exhaust tube (not shown).

Figure 10:
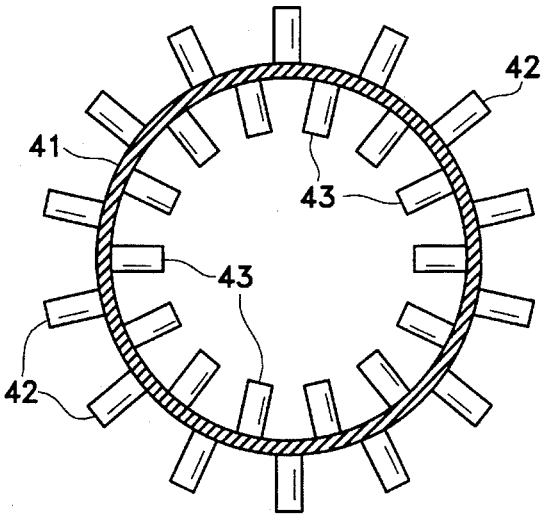
FIG. 10 is a cross sectional view of the outer housing taken along the lines 10—10.

Referring now to FIGS. 10 and 11, an external housing 41 is shown. This external housing 41 has a number of studs 42 placed on the outside of the housing in a symmetrical manner. The studs 42 help to radiate heat from the muffler 15. A similar set of studs 43 is formed within the housing 41. The inner studs 43 help to create turbulence within the exhaust, thereby improving attenuation and heat transfer to the outside of the housing for cabin heat.

Referring now to FIG. 6 and 8, the muffler 15 is used by injecting exhaust from an engine into the inlet end 28. The exhaust gas moves to the partition plate 29 where it is stopped. The gas, which is under pressure, is forced to flow through the inlet set of holes 21. Here the depression 23 and flare 24 portions of the holes 21 act to maximize flow. Note the air flow as shown in FIG. 8. The exhaust is then moved through the inner portion of the outer housing, where it encounters the studs 43, until it reaches the outlet holes, where again, the flare 24 and depression 23 of the holes 21, helps to direct the airflow. The exhaust then passes through the outlet holes 21 and then through the outlet end 27 of the muffler 15, where it can be exhausted from the vehicle.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An aircraft muffler comprising:

a) an exhaust gas conduit having a cylindrical wall, said cylindrical wall having an outer surface, an inlet, an outlet, and a hollow interior;

b) partition means for sealing the hollow interior of said exhaust gas conduit, positioned within said exhaust gas conduit at a point intermediate of the inlet and outlet, to prevent the flow of exhaust gas therethrough;

c) a plurality of perforations formed through the cylindrical wall of said exhaust conduit in a region upstream and downstream of said partition means, said plurality of perforations being formed such that the cylindrical wall of said exhaust gas conduit is raised upward above the outer surface of said cylindrical wall for each perforation at a point in those perforations closest to the inlet, on the inlet side of the partition means, and the cylindrical wall of said exhaust gas conduit is depressed downward below the outer surface of said cylindrical wall, for each perforation at a point in the perforations closest to the outlet, on the outlet side of the partition means;

d) an outer housing, sealably placed over said exhaust gas conduit, to constrain the flow of exhaust gasses within the outer housing; and e) connection means for connecting said aircraft muffler to an aircraft exhaust system.

2. The aircraft muffler of claim 1 wherein said perforations surrounding said partition means form a crimped edge around said partition means to help hold said partition means in place.

3. The aircraft muffler of claim 1 wherein said partition means is held in place by a plurality of welds spaced equidistant around said partition means.

4. The aircraft muffler of claim 1 wherein said outer housing further comprises: an inner surface and an outer surface, said inner surface and said outer surface having a plurality of studs, fixedly attached and extending perpendicularly from said inner surface and said outer surface.

5. The aircraft muffler of claim 2 wherein said partition means is further held in place by a plurality of welds spaced equidistant around said partition means.

6. The aircraft muffler of claim 2 wherein said crimped edge forms an inherent, integral bead lock around said partition means.

7. A method of building an aircraft muffler exhaust comprising the steps of:

a) forming an exhaust gas conduit having a cylindrical wall having an outer surface, an inlet and an outlet, and a hollow interior;

b) fixedly installing a partition plate within said exhaust gas conduit at a point intermediate to said inlet and outlet;

c) drilling a plurality of holes in said cylindrical wall of said exhaust gas conduit, both upstream and downstream of said partition plate; and d) raising the cylindrical wall of said exhaust gas conduit above the outer surface of said exhaust gas conduit about said plurality of holes at a point of each hole closest to the inlet, on the inlet side of the partition plate of said cylindrical wall of said exhaust gas conduit;

e) raising the cylindrical wall of said exhaust gas conduit above the outer surface of said exhaust gas conduit about said plurality of holes at a point of each hole closest to the outlet, on the outlet side of the partition plate of said cylindrical wall of said exhaust gas conduit;

f) depressing the cylindrical wall of said exhaust gas conduit below the outer surface of said exhaust gas conduit about said plurality of holes at a point of each hole closest to the outlet, on the inlet side of the partition plate of said cylindrical wall of said exhaust gas conduit; and g) depressing the cylindrical wall of said exhaust gas conduit below the outer surface of said exhaust gas conduit about said plurality of holes at a point of each hole closest to the inlet, on the outlet side of the partition plate of said cylindrical wall of said exhaust gas conduit.

8. The method of building an aircraft muffler exhaust of claim 7 further comprising the steps of:

a) encasing said exhaust gas conduit in an outer housing having an inside and an outside; and b) sealing said outer housing to prevent the escape of exhaust gases passing therethrough.

9. The method of building an aircraft muffler exhaust of claim 8 further comprising the steps of:

a) attaching a plurality of studs that extend outwardly and perpendicularly from the inside of said outer housing before placing said outer housing over said exhaust gas conduit; and b) attaching a plurality of studs that extend outwardly and perpendicularly from the outside of said outer housing.

* * * * *